US005097177A

United States Patent [19]

Chiang

[11] Patent Number: 5,097,177

[45] Date of Patent: Mar. 17, 1992

[54] GLOW STARTER WITH A FASTER TURN ON TIME FOR A FLUORESCENT TUBE

[76] Inventor: Chun S. Chiang, 9-1, Lane 161, Hsing An Road Sec. 1, Taichung, Taiwan

[21] Appl. No.: 635,946

[22] Filed: Dec. 28, 1990

[51] Int. Cl.[5] ..... H01J 17/30; H01J 61/64

[52] U.S. Cl. ..... 313/619; 313/620; 313/623; 337/22

[58] Field of Search ..... 313/619, 620, 623, 643; 315/73; 337/22, 23, 24, 25, 26, 27

[56] References Cited

U.S. PATENT DOCUMENTS

| | | | |
|---|---|---|---|
| 2,286,790 | 6/1942 | Dench | 337/22 |
| 4,837,483 | 6/1989 | Kling | 313/619 |
| 4,845,406 | 7/1989 | Barakitis | 313/620 |

*Primary Examiner*—Donald J. Yusko
*Assistant Examiner*—Nimrohkumar D. Patel

[57] ABSTRACT

A quick start initiator for a flourescent light comprises a sealed glass bulb, a long conductor rod centrally located within the bulb, a pair of short conductor rods positioned to either side of the long conductor and electrically connected with a conducting lead protruding from the base of the glass bulb, and a pair of thermally deforming arcuate strips each being electrically connected to one of the short conductor rods. Wherein one arcuate bimetallic strip attached to one short conductor bar is normally separated by a space from the central conductor bar when in the inactive state. The other arcuate bimetallic strip on the other short conductor bar normally contacts the central long conductor when inactive. A mixture of argon and neon gases fills the glass bulb. Each of the leads are electrically connected in series with one respective cathode of a flourescent tube as in a conventional flourescent tube initiator circuit.

4 Claims, 3 Drawing Sheets

GLOW STARTER WITH A FASTER TURN ON TIME FOR A FLUORESCENT TUBE

BACKGROUND OF THE INVENTION

Referring to FIG. 1, an initiator circuit for a flourescent tube is shown in schematic form. The terminal A and B are connected to an AC power source at a normal voltage of 110 volts. Clockwise from terminal B, the right cathode filament 11*b* of flourescent tube 10, conventional glow starter 14, power switch 13, the left cathode filament 11*a* of flourescent tube 10, and ballast 12 are all connected in series between terminals A and B. Capacitor 15 is connected in parallel with the terminals of conventional glow starter 14.

The conventional glow starter 14 is normally enclosed in a plastic, cylindrical module whose internal structure is shown in FIG. 2. A hermetically sealed glass bulb 142, filled with a mixture of argon and neon gas, is enclosed by translucent plastic enclosure 141. Contact plate 143 and bimetallic strip 144 made of two metallic alloys of dissimilar coefficients of thermal expansion to facilitate expansion and contraction of the strip with changes in temperature, are attached to electrically conductive support wires 145*a* and 145*b*, respectively, which in turn extend through the base of glass bulb 142 to attach with respective terminals 146*a* and 146*b* disposed on the bottom of the glow starter 14.

In operation, the power switch 13 of FIG. 1 is first closed which impresses an AC voltage across the terminals 146*a* and 146*b* of the glow starter 14 with little voltage drop from the other components.

The voltage is sufficient to cause ionization of the gas between contact plate 143 and bimetallic strip 144, causing a glow discharge between the two. The glow discharge heats the bimetallic strip 144 causing it to expand until it makes contact with contact plate 143, at which point the glow discharge is extinguished and the circuit is closed. Current flowing through cathode filaments 11*a* and 11*b* heats them to a temperature where thermionic emission occurs initiating ionization of the gas within the flourescent tube 10 and evaporating the mercury within it.

With the glow discharge extinguished, the bimetallic strip 144 cools and contracts away from contact plate 143, breaking the circuit and returning to its original position. Once broken, a large inductive back EMF is generated by ballast 12 which sparks an ion current between cathode filaments 11*a* and 11*b* to initiate normal operation of flourescent tube 10. The voltage is then effectively shunted across the flourescent tube 10, leaving insufficient voltage between the terminals 146*a* and 146*b* to cause further ionization in the glow starter 14.

The capacitor 15 in parallel with the glow starter 14 serves to aid in stabilizing the fluctuating currents concomitant with the tube's operation as does the ballast.

A major drawback of a conventional glow starter is that the bimetallic strip 144 has a relatively long time constant, i.e., it requires a relatively long period of time for the bimetallic strip 144 to heat sufficiently for closure with contact plate 143. This is due to the relative thickness of bimetallic strip 144 and its concomitant high heat capacity required for the bimetallic strip 144 to remain in contact with the contact plate 143 for a duration of time to sufficiently heat the cathode filaments 11*a* and 11*b*.

In the improved glow starter of the present invention, much thinner bimetallic strips are used with shorter time constants, a different bimetallic strip being used for the successive functions of making and breaking the initiator circuit.

This not only leads to shorter turn-on times for flourescent tubes but aids in extending the service life of the tubes by avoiding over heating of the cathode filaments.

SUMMARY OF THE PRESENT INVENTION

The improved glow starter of the present invention has as a primary object the provision of a glow starter with a faster turn on time relative to a conventional glow starter and as a secondary object the provision of a glow starter that prolongs the service life of a flourescent tube.

The improved glow starter of the present invention utilizes two independant thermally expanding bimetallic strips. A first bimetallic strip, forming one terminal of a normally open thermally activated switch, is closed quickly by a glow discharge to close the initiator circuit and heat the cathode filaments. A second bimetallic strip forms a terminal of a normally closed thermally activated switch in series with the normally open switch. After sufficient time has elasped for the cathode filaments to heat sufficiently, the second thermally activated switch opens to allow the ballast to spark over the flourescent tube to normal operation. Both bimetallic strips thereupon return to their original respective states, the reduced voltage across the glow starter, due to the shunting effect of the lighted flourescent tube, being insufficient to cause further glow discharge in the first thermally activated switch.

The second thermally activated switch is heated either by an ohmic heater or by magnetically induced ionization of the gas surrounding the second bimetallic strip.

In certain embodiments, a single glass bulb, filled with a suitable gas mixture, is used with two terminals protruding from the bottom thereof. A first conductor rod and a second conductor rod are disposed within the glass bulb having a first bimetallic strip and a second bimetallic strip attached to their respective upper ends. The lower ends being attached to a respective terminal. Between the first and second conductor rods is disposed a third, central conductor rod which acts as a contact and electrical connector between the first thermally activated switch and the second thermally activated switch. The first thermally activated switch comprises the first conductor rod, the central conductor rod, and the first bimetallic strip which is normally not in contact with the central conductor rod. Likewise, the second conductor rod and bimetallic strip from the second thermally activated switch with the central conductor rod. The second conductor rod normally is in contact with the central conductor rod. In an embodiment using ohmic heating to close the second thermally activated switch, a vertically disposed resistor with contacts on either end replaces the central conductor rod. The first bimetallic strip contacts the upper contact when activated and the second bimetallic strip contacts the lower contact when inactivated.

Other embodiments utilize two separate glass bulbs, each having a bimetallic strip attached to a first conductor rod which in turn is attached to a first terminal protruding from the base thereof. The second terminal, of each bulb, is either attached to another conductor rod or heating resistor, dependant on whether magnetic ionization or ohmic heating is used for activation of the bimetallic strip, in separate embodiments.

Regardless of the embodiment, the bimetallic strip within the first glass bulb is normally not in contact with its respective conductor rod or heating resistor, while the bimetallic strip within the second glass bulb normally is in contact.

An electrical path is formed between the second terminal of the first glass bulb and the first terminal of the second glass bulb.

BRIEF DESCRIPTION OF THE DRAWINGS

The invention is hereinafter described with reference to the accompanying drawings in which.

DETAILED DESCRIPTION OF THE PREFERRED EMBODIMENTS

Figure 3:
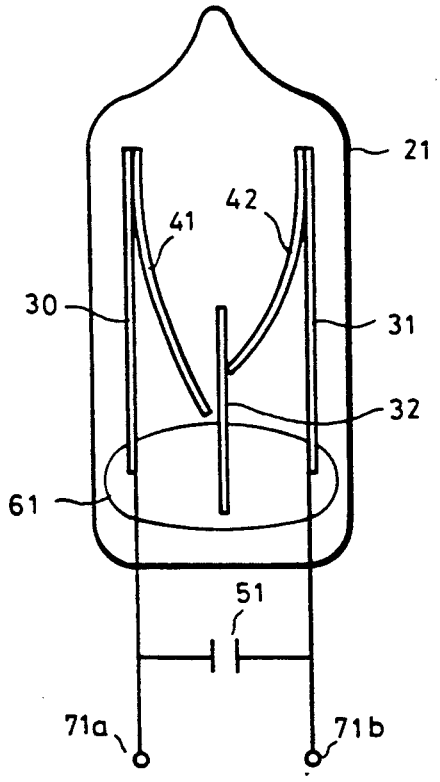
FIG. 3 is a schematic view of a first embodiment of the present invention.
Figure 6:
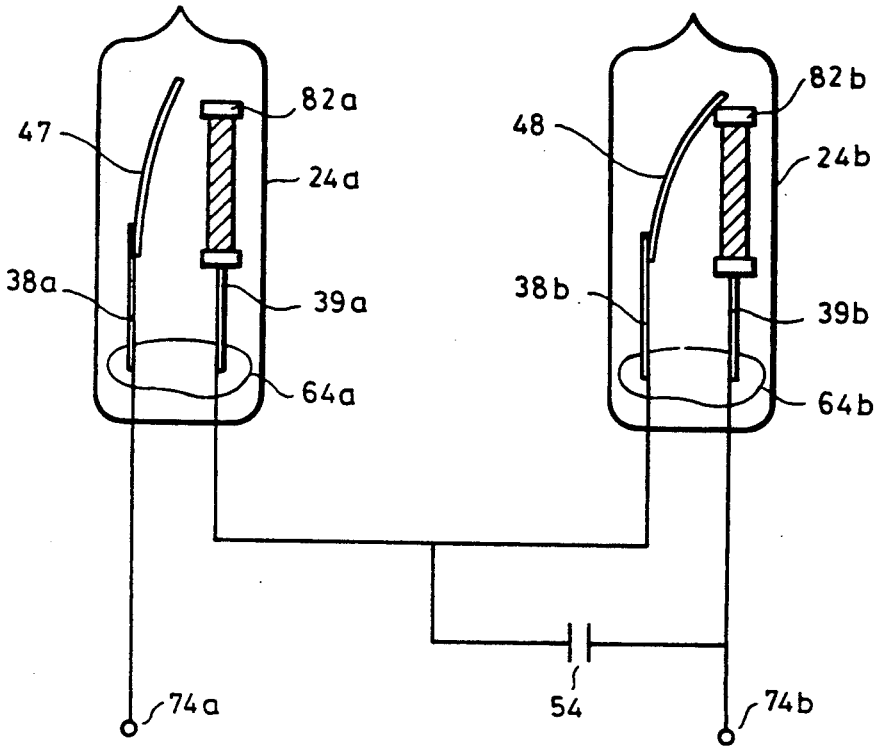
FIG. 6 is a schematic view of a fourth embodiment of the present invention.

Referring to FIG. 3, a first embodiment of the present invention comprises a sealed glass bulb 21, a pair of long conductor rods 30 and 31, a short conductor rod 32, a pair of bimetallic strips 41 and 42, and a pair of terminals 71*a* and 71*b*.

The short conductor rod 32 is centrally located within glass bulb 21, secured in place by plug 61. Long conductor rods 30 and 31 are positioned to either side of short conductor rod 32, passing through plug 61 to attach to and form an electrically conducting path with terminals 71*a* and 71*b*, respectively. Arcuate bimetallic strips 41 and 42 are made from adjoined layers of metals or alloys with different thermal coefficients of expansion such as brass and invar, causing them to change curvature with temperature.

Bimetallic strips 41 and 42 are welded to the upper ends of respective long conductor rods 30 and 31. When inactive, the unattached end of bimetallic strip 41 is in proximity to but not contacting short conductor rod 32. While, on the other side, bimetallic strip 42 attached on one end to long conductor bar 31, contacts short conductor rod 32 with its other end.

Figure 1:
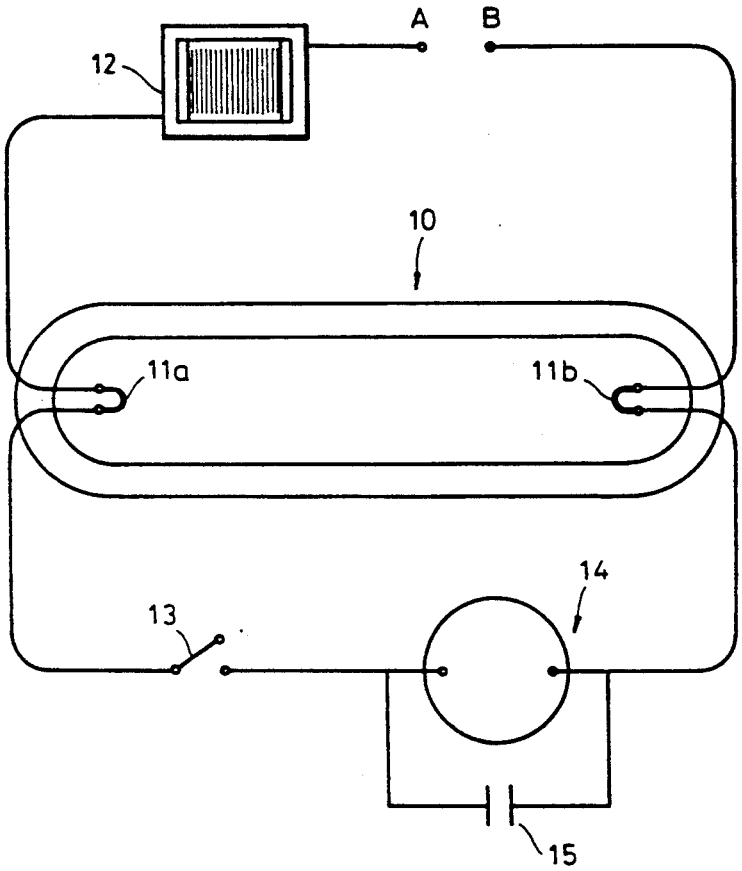
FIG. 1 is a schematic drawing of a flourescent light initiator circuit.
Figure 2:
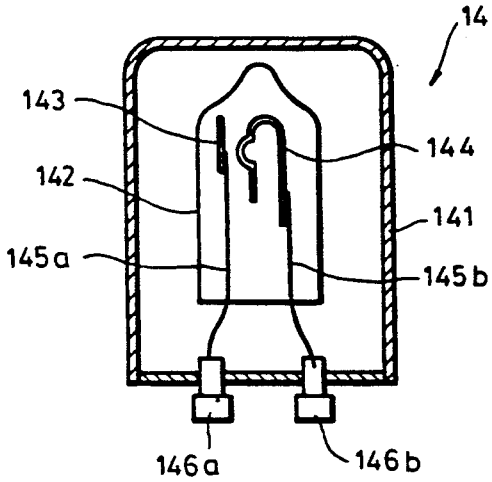
FIG. 2 is a cut open view a conventional glow starter module.

The terminals 71*a* and 71*b* are electrically connected in series with respective cathode filaments of a flourescent tube in like manner as with the terminals of a conventional glow starter in the flourescent light initiator circuit of FIG. 1.

The hermetically sealed glass bulb 21, is filled mainly with a gaseous mixture of argon and neon in a roughly 1:3 ratio, with an admixture of hydrogen, at a pressure of approximately 2 torr. When power is switched on in the flourescent light initiator circuit, there is little voltage drop in the ballast and almost the full RMS line voltage of 110 volts is applied between terminals 71*a* and 71*b*. This is more than enough voltage to cause ionization of the neon and argon gas between bimetallic strip 41 and short conductor rod 32. The resultant glow discharge rapidly heats up bimetallic strip 41, which has a much shorter time constant in comparison to a corresponding bimetallic strip as formed in a conventional glow starter due to its much narrower width. The bimetallic strip 41 then bends and contacts short conductor rod 32, at which point current flows between terminals 71*a* and 71*b*, and through the cathode filaments of the flourescent tube. After a few tenths of a second, the cathode filaments reach a high enough temperature for thermionic emission of electrons to occur.

Concomitantly, the flow of current through bimetallic strip 42, which normally is in contact with short conductor rod 32, generates a surrounding magnetic field thereon. This magnetic field causes ionization of the argon-neon gas mixture, with the hydrogen content serving to stabilize the plasma of argon and neon free radicals. The ionization heats bimetallic strip 42 until it bends away and breaks contact with short conductor rod 32. The time duration from the initial flow of current to the moment of breaking contact is sufficient to allowing heating of the cathode filaments to thermionic emission. Upon breaking contact, the circuit of the flourescent tube initiator is broken and a large inductive back EMF is generated by the ballast, which causes the opposing filament cathodes of the flourescent tube to arc over and initiate normal operation of the flourescent tube.

At which point, current flows through the flourescent tube, and the voltage across the terminal 71*a* and 71*b* is shorted out, dropping to below 55 volts which is insufficient to cause further magnetic ionization around bimetallic strip 42, causing it to cool and break contact with shorter conductor rod 32. After the circuit is once again completed, bimetallic strip 41 will have cooled sufficiently to allow it to bend back and break contact with short conductor rod 32. The remaining voltage is insufficient to cause further glow discharge between bimetallic strip 41 and short conductor rod 32. Thus both bimetallic strip 41 and bimetallic strip 42 remain in their original positions until power is removed and a new start cycle is initiated.

Figure 4:
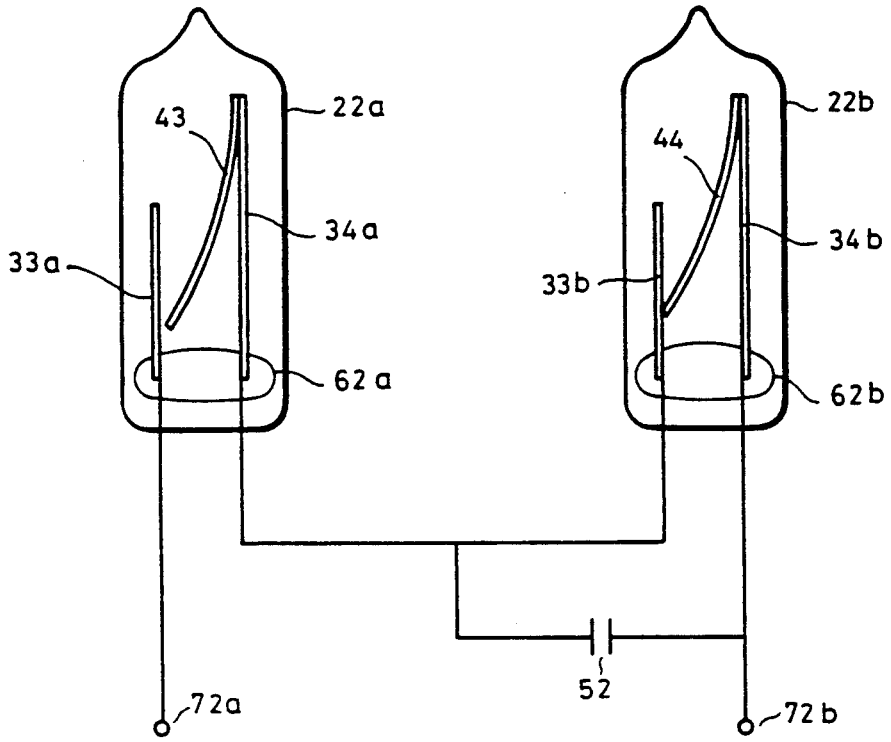
FIG. 4 is a schematic view of a second embodiment of the present invention.

In an alternate embodiment of the present invention, as shown in FIG. 4, two sealed tubes 22*a* and 22*b* are used. A pair of short conductor rods 33*a* and 33*b* are located in respective sealed glass bulbs 22*a* and 22*b*. Likewise, a pair of long conductor rods 34*a* and 34*b* are located in respective sealed glass bulbs 22*a* and 22*b*, secured with respective short conductor rods 33*a* and 33*b* by respective plugs 62*a* and 62*b*.

Bimetallic strips 43 and 44 are welded to the upper ends of respective long conductor rods 34*a* and 34*b*. When inactive, the unattached end of bimetallic strip 43 is in proximity to but not contacting short conductor rod 33*a*, while bimetallic strip 44 contacts short conductor rod 33*b* with its free end.

Short conductor rod 33*a* and long conductor rod 34*b* have electrically conducting paths with respective terminals 72*a* and 72*b*, while long conductor rod 34*a* has an electrically conducting path to short conductor 33*b*.

The terminals 72*a* and 72*b* are connected to a flourescent tube in a conventional flourescent light initiator circuit as with the all embodiments.

Capacitor 52 connected in parallel with terminal 72*b* and the cross conductor between long conductor rod 34*a* and short conductor 33*b* serves to stabilize the circuit as in a conventional glow starter.

The sealed glass bulbs 22*a* and 22*b* are filled with a gaseous mixture of similar composition and manner as with the former embodiment. When power is switched on in the flourescent light initiator circuit, almost the full RMS line voltage of 110 volts is applied between terminals 72a and 72b. This causes ionization and a glow discharge between bimetallic strip 43 and short conductor rod 33a. The bimetallic strip 43 then bends and contacts short conductor rod 33a. Current then flows between terminals 72a and 72b, quickly heating the cathode filaments of the flourescent tube to thermionic emission.

Concomitantly, the current flow through bimetallic strip 44, generates a surrounding magnetic field thereon. This initiates ionization and a glow discharge. This heats bimetallic strips 44 causing it to bend and break contact with short conductor rod 33b and open the circuit of the flourescent tube initiator. By then the cathode filaments of the flourescent tube will have heated sufficiently and upon opening of the circuit inductive back EMF from the ballast causes the flourescent tube to arc over and initiate normal operation.

With the current shunted across the flourescent tube, the voltage across the terminals 72a and 72b is insufficient to cause further ionization around bimetallic strip 44b, in sealed glass bulb 22b, which cools and once again makes contact with short conductor rod 33b. With insufficient voltage to cause ionization in glass bulb 22a, the bimetallic strips 43 and 44 in glass bulbs 22a and 22b will remain in their original positions until a new start cycle is initiated.

Figure 5:
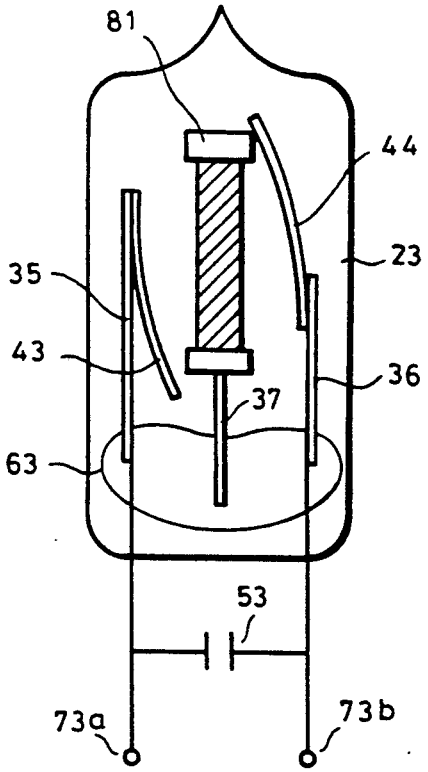
FIG. 5 is a schematic view of a third embodiment of the present invention.

In yet another embodiment of the present invention, as shown in FIG. 5, a single sealed glass bulb 23 is used as with the first embodiment. A long conductor rod 35 and a short conductor rod 36 have bimetallic strips 45 and 46 welded to their respective upper ends, with bimetallic strips 45 extending downwards and bimetallic strips 46 extending upwards.

The lower ends of long conductor rod 35 and short conductor rod 36 are secured in place by plug 63, and form an electrically conducting path with terminals 73a and 73b, respectively. The terminal 73a and 73b are connected to an initiator circuit in the conventional manner with a capacitor 53 connected therebetween providing the same stabilizing function as a capacitor within a conventional glow starter.

Centrally located, and supported by support rod 37 whose lower end is secured to plug 63, is a resistive heater 81, utilizing a manganese dioxide spiral formed over a cylindrical body and terminated by conductive ends caps.

The operation of the glow starter is similar with that of the first embodiment. When power is applied, ionization and a glow discharge occurs between the lower end of bimetallic strip 45 and the lower conductive end cap of resistive heater 81, causing the bimetallic strip 45 to bend and make contact, thereby closing the initiator circuit.

However, instead of utilizing magnetic ionization to heat the second bimetallic strip, current through resistive heater 81 causes it to create heat and once transfered to bimetallic strip 46, to bend and lose contact, breaking the initiator circuit. As with all embodiments the flourescent tube then arcs over due to the action of the ballast, and both bimetallic strips 45 and 46 return to their original positions until a new cycle is initiated.

In a final embodiment of the present invention, two sealed glass bulbs 24a and 24b are used along with a resistive heater 82a and 82b in each respective bulb.

A bimetallic strip 47 and 48 whose lower ends are welded to short conductor rods 38a and 38b, respectively, are disposed within respective glass bulbs 24a and 24b. The lower ends of support rods 39a and 39b, for respective resistive heaters 82a and 82b, are secured to respective plugs 64a and 64b as are the respective lower ends of short conductor rods 38a and 38b.

Terminals 74a and 74b have an electrically conducting path with short conductor rods 38a and support rod 39b, respectively, and are connected to an initiator circuit in a conventional manner.

In a similar fashion with the previous dual bulb embodiment, the support rod 39a has an electrically conducting path with short conductor rod 38b.

Capacitor 54 acts as a stabilizer as in a conventional glow starter.

In operation, when power is turned on, ionization and glow discharge occurs between bimetallic strip 47 and the upper end cap of resistive heater 82a, causing the bimetallic strip 47 to bend and make contact, closing the initiator circuit and sending current through resistive heater 82b. After a sufficient time interval to heat the cathode filaments of the flourescent tube has elapsed, bimetallic strip 48 will bend away and break contact with the upper end cap of resistive heater 82b, opening the initiator circuit.

After the flourescent tube arcs over, both bimetallic strips 47 and 48 will have returned to their original positions, remaining there until a new start cycle is initiated.

Further modifications of the invention herein described will occur to persons skilled in the art and all such modifications are deemed to be within the scope of the invention as defined by the appended claims.

I claim:

1. An improved glow starter for a flourescent light comprising:

a sealed glass bulb filled with a gaseous mixture comprising argon and neon;

a short conductor rod centrally positioned within said bulb;

a first long conductor rod and a second long conductor rod disposed on either side of said short conductor rod, each of said long conductors attached to and forming an electrically conducting path with a respective first terminal and second terminal, which protrude from the base of said bulb;

a first thermally deforming bimetallic strip and a second thermally deforming bimetallic strip attached to and forming an electrically conducting path with said first long conductor rod and said second long conductor rod, respectively;

a first thermally activated switch being normally open when said glow starter is inactive and defined by said first thermally deforming bimetallic strip which is attached to said first long conducting rod, and said short conducting rod, which closes, forming an electrically conducting path between said first long conducting rod and said short conducting rod, when activated by a glow discharge between said first thermally deforming bimetallic strip and said short conductor, causing said first thermally deforming bimetallic strip to bend and make contact with said short conductor rod;

a second thermally activated switch being normally closed when said glow starter is inactive and defined by said second thermally deforming bimetallic strip which is attached to said second long conducting rod, and said short conducting rod, forming a electrically conducting path between said second long conducting rod and said short conducting rod, which opens when activated by magnetic ionization between said short conductor rod and said second thermally deforming bimetallic strip, causing said second thermally deforming bimetallic strip to bend and break contact with said short conductor rod;

wherein, said first terminal and said second terminal each have an electrical path in series with respective cathode filaments of a flourescent tube.

2. An improved glow starter for a flourescent light comprising:

a first sealed glass bulb and a second sealed glass bulb, both said first sealed glass bulb and said second sealed glass bulb filled therein with a gaseous mixture comprising argon and neon;

a first long conductor rod and a second long conductor rod located respectively in said first sealed glass bulb and said second sealed glass bulb, attached to and forming an electrically conducting path with a respective first terminal and second terminal, protruding from the bases of respective said first sealed glass bulb and said second sealed glass bulb;

a first short conductor rod and a second short conductor rod disposed in respective said first sealed glass bulb and said second sealed glass bulb, next to respective said first long conductor rod and said second long conductor rod, attached to and forming an electrically conducting path with a respective third terminal and fourth terminal, which protrude from the bases of respective said first sealed glass bulb and second sealed glass bulb;

a first thermally deforming bimetallic strip and a second thermally deforming bimetallic strip, attached to and forming an electrically conducting path with respective said first long conductor rod and said second long conductor rod;

a first thermally activated switch being normally open when said glow starter is inactive and defined by said first thermally deforming bimetallic strip which is attached to said first long conductor rod, and said first short conductor rod, which closes, forming an electrically conducting path between said short conductor rod and said long conductor rod of said first sealed glass bulb, when activated by a glow discharge between said first short conductor rod and said first thermally deforming bimetallic strip, causing said first thermally deforming bimetallic strip to bend and make contact with said first short conductor rod;

a second thermally activated switch being normally closed when said glow starter is inactive and defined by said second thermally deforming bimetallic strip which is attached to said second long conductor, and said second short conductor, forming an electrically closed path between said second short conductor rod and said second long conductor rod of said second sealed glass bulb, which opens when activated by magnetic ionization between said second short conductor rod and said second thermally deforming bimetallic strip, causing said second thermally deforming bimetallic strip to bend and break contact with said second short conductor rod;

wherein, said first terminal of said first sealed glass tube has an electrical path to said fourth terminal of said second sealed glass tube, and said third terminal of said first sealed glass tube, and said second terminal of said second sealed glass tube each have an electrical path with respective cathode filaments of a flourescent tube as in a conventional flourescent tube initiator circuit.

3. An improved glow starter for a flourescent light comprising:

a sealed glass bulb filled with a gaseous mixture comprising argon and neon;

a support rod centrally positioned within said bulb;

an ohmic heating element providing an electrically conducting upper contact plate and lower contact plate, said lower contact plate being attached to the upper end of said support rod;

a first conductor rod and a second conductor rod, disposed to either side of said ohmic heating element, each of said first and second conductor rods attached to and forming an electrically conducting path with a respective first terminal and second terminal, which protrude from the base of said bulb;

a first thermally activated switch being normally open when said glow starter is inactive and defined by said first thermally deforming bimetallic strip which is attached to said first conducting rod, and said lower contact plate, which closes, forming an electrically conducting path between said first conducting rod and said lower contact plate, when activated by a glow discharge between said first thermally deforming bimetallic strip and said lower contact plate, causing said first thermally deforming bimetallic strip to bend and make contact with said lower contact plate;

a second thermally activated switch being normally closed when said glow starter is inactive and defined by said second thermally deforming bimetallic strip which is attached to said second conducting rod, and said upper contact plate, forming a electrically conducting path between said second conducting rod and said upper contact plate, which opens when activated by heating of said ohmic heating element, causing said second thermally deforming bimetallic strip to bend and break contact with said upper contact plate;

wherein, said first terminal and said second terminal each have an electrical path in series with respective cathode filaments of a flourescent tube.

4. An improved glow starter for a flourescent light comprising:

a first sealed glass bulb and a second sealed glass bulb, both said first sealed glass bulb and said second sealed glass bulb filled therein with a gaseous mixture comprising argon and neon;

a first conductor rod and a second conductor rod, disposed in respective said first sealed glass bulb and said second sealed glass bulb, attached to and forming an electrically conductive path with a respective first terminal and second terminal protruding from the bases of respective said first sealed glass bulb and said second sealed glass bulb;

a first conductive support rod and a second conductive support rod disposed in respective said first sealed glass bulb and said second sealed glass bulb, next to respective said first conductor rod and said second conductor rod, attached to and forming an electrically conducting path with a respective third terminal and fourth terminal, which protrude from the bases of respective said first sealed glass bulb and second sealed glass bulb;

a first ohmic heating element and a second ohmic heating element, each providing an electrically conductive top contact plate and electrically conductive bottom contact plate, said bottom contact plates of said first ohmic heating element and said second ohmic heating element being attached to said first conductive support rod and said second conductive support rod, respectively;

a first thermally deforming bimetallic strip and a second thermally deforming bimetallic strip, attached to and forming an electrically conducting path with respective said first conductor rod and said second conductor rod;

a first thermally activated switch being normally open when said glow starter is inactive and defined by said first thermally deforming bimetallic strip which is attached to said first conductor rod, and said upper contact plate of said first ohmic heating element, which closes, when activated by glow discharge between said first thermally deforming bimetallic strip and said upper contact plate of said first ohmic heating element, causing said first thermally deforming bimetallic strip to bend and make contact with said upper contact plate of said first ohmic heating element;

a second thermally activated switch being normally closed when said glow starter is inactive and defined by said second thermally deforming bimetallic strip which is attached to said second conductor rod, and said upper contact plate of said second ohmic heating element, which opens when activated by the heating of said second ohmic heating element, causing said second thermally deforming bimetallic strip to bend and break contact with said upper contact plate of said second ohmic heating element;

wherein, said first terminal of said first sealed glass tube has an electrical path to said fourth terminal of said second sealed glass tube, and said third terminal of said first sealed glass tube, and said second terminal of said second sealed glass tube each have an electrical path with respective cathode filaments of a flourescent tube.

* * * * *